US006322647B1

(12) United States Patent
Kamat et al.

(10) Patent No.: US 6,322,647 B1
(45) Date of Patent: Nov. 27, 2001

(54) METHODS OF IMPROVING HOT WORKING PRODUCTIVITY AND CORROSION RESISTANCE IN AA7000 SERIES ALUMINUM ALLOYS AND PRODUCTS THEREFROM

(75) Inventors: Rajeev G. Kamat; Subhasish Sircar, both of Richmond, VA (US)

(73) Assignee: Reynolds Metals Company, Richmond, VA (US)

( * ) Notice: Subject to any disclaimer, the term of this patent is extended or adjusted under 35 U.S.C. 154(b) by 0 days.

(21) Appl. No.: 09/169,293

(22) Filed: Oct. 9, 1998

(51) Int. Cl.[7] ..... C22C 21/00; C22F 1/04

(52) U.S. Cl. ..... 148/690; 148/693; 148/694; 148/437; 148/439

(58) Field of Search ..... 148/690, 694, 148/439, 437, 692, 693

(56) References Cited

U.S. PATENT DOCUMENTS

| | | | | |
|---|---|---|---|---|
| 4,196,021 | | 4/1980 | Bouvaist et al. | 148/552 |
| 4,482,012 | | 11/1984 | Young et al. | 165/146 |
| 4,806,174 | * | 2/1989 | Cho et al. | 148/415 |
| 5,571,346 | * | 11/1996 | Bergsma | 148/550 |
| 5,730,198 | | 3/1998 | Sircar | 164/4.1 |

FOREIGN PATENT DOCUMENTS

| | | | |
|---|---|---|---|
| 81441 | * | 6/1983 | (EP) . |
| 60 125354 | * | 7/1985 | (JP) . |
| 60234955 | * | 11/1985 | (JP) . |

OTHER PUBLICATIONS

Kenney et al., Semisolid Metal Casting and Forging, *Metals Handbook*, vol. 15, 9$^{th}$ Ed., Casting, pp. 327–338, 1988.

* cited by examiner

*Primary Examiner*—Sikyin Ip

(57) ABSTRACT

Methods of improving the corrosion resistance and hot working productivity of AA7000 series aluminum alloys include, in one mode, the steps of treating a stock material to form a globular microstructure, preferably by a thermal conversion treatment, and subsequently hot working the treated stock material, quenching it and aging it. The globular microstructure permits increasing the hot working rate to attain T6 properties using only a T5 temper practice and without adverse effect on the surface of the hot worked product as a result of the increased hot working rate. Consequently, an acceptable product is made at a significantly lower cost due to the increased hot working rates and fewer processing steps. The method also improves the corrosion resistance, particularly exfoliation corrosion resistance, of the product such that corrosion resistance generally attainable using only a T7 temper practice is achieved using only a T5 temper practice.

15 Claims, 1 Drawing Sheet

METHODS OF IMPROVING HOT WORKING PRODUCTIVITY AND CORROSION RESISTANCE IN AA7000 SERIES ALUMINUM ALLOYS AND PRODUCTS THEREFROM

FIELD OF THE INVENTION

The present invention is directed to methods of improving hot working productivity and the corrosion resistance of AA7000 series aluminum alloys and products therefrom and, in particular, to methods which permit increased working speeds while maintaining acceptable surface appearance and desired mechanical properties and which attain exfoliation corrosion resistance without requiring additional aging practices.

BACKGROUND ART

In the prior art, the AA7000 series aluminum alloys, by virtue of their high strength, good corrosion resistance and high toughness, have been used in a wide range of applications. These alloys are often used in aircraft or aerospace components, automobile components, and in other high performance applications as plate and sheet products, extrusions, forgings, etc. These alloys generally contain zinc as a major alloying element and can also contain magnesium, copper and chromium. For example, the Aluminum Association limits for AA7075 are, in weight percent, 1.2–2.0% copper, 2.1–2.9% magnesium, 5.1–6.1% zinc and 0.18–0.28% chromium as major alloying elements.

Although the AA7000 series aluminum alloys offer significant benefits in terms of their various properties, these alloys can be difficult to hot work, particularly to extrude. Often times, these alloys are characterized as "hard to extrude" alloys.

As a result of the difficulty in hot working these types of alloys, the hot working rate, e.g., the extrusion speed, is generally conducted at relatively low rates, thereby compromising productivity.

As a consequence of this slow hot working rate or extrusion speed, aluminum alloy producers cannot take advantage of the economic savings associated with press quenching these types of materials. Press quenching is a method of combining solution heat treatment with extruding whereby the separate solution heat treating and quenching step used on heat treatable alloys is eliminated. In press quenching, the solution heat treatment that is typically performed in a separate step is combined as part of the hot working operation. Following press quenching, the material can be artificially or naturally aged to achieve the desired hardening effects. Press quenching and aging is generally designated as a T5 temper practice, compared to a T6 temper which includes a solutionizing step.

FIG. 1 schematically depicts various prior art processing techniques. The T5 temper practice is best represented by the homogenization step 1, the hot working and quenching step 3 and the aging step 5.

Prior art attempts to subject these types of alloys to press quenching or T5 temper practice by trying to optimize the quenching following hot working has not been generally successful to date. Quenching these "hard to extrude" alloys at the exit of a hot working operation, particularly an extrusion press, could result in cooling of the hot working tool, particularly the extrusion die. This cooling adversely affects the extrusion process. In other words, properties based on a T5 temper practice cannot be readily achieved by controlling the quenching following the hot working operation for these type of aluminum alloys.

As a result of the inability to achieve a T5 temper product in these "hard to extrude" alloys, these alloys are subjected to subsequent solution heat treating, quenching and aging (artificial or natural) as shown in steps 7 and 9 of FIG. 1. This practice is commonly referred to as a T6 temper practice and imparts the desired precipitation hardening effect in these heat treatable alloys.

While the solution heat treating, quenching and aging contribute to the improved mechanical properties of these types of alloys, other drawbacks can occur. For example, besides the higher energy costs required to perform a separate solution heat treating step, reheating the hot worked and quenched product can result in distortion of the hot worked product, particularly when the solution heat treating and quenching is conducted with the product in a horizontal configuration. Distortion to the product can be minimized using vertical quenching apparatus. However, this equipment is complicated and expensive and the use of such further adds to the overall cost of the T6 temper practice. Solution heat treating can also adversely affect corrosion resistance due to the occurrence of recrystallization, particularly at the workpiece surface. Grain growth at the surface presents a more conducive structure for corrosive attack, thereby potentially compromising the corrosion properties of a material at the expense of improved mechanical properties.

Other attempts to overcome the difficulty in press quenching these hard to extrude alloys have been made by increasing the hot working rate or speed. The theory behind this practice is to move the workpiece through the hot working operation at a faster rate so that the quenching can successfully retain the alloying elements in solution for a subsequent aging response. However, since the AA7000 series materials are hard to work or extrude, increasing the hot working rate results in surface tearing or galling of the product. Since the material is hard, excessive friction occurs at the material-hot working tool interface, thereby causing localized temperature increases and generation of surface defects.

Besides the problems noted above in AA7000 series alloys, another drawback exists with respect to applications requiring good corrosion resistance, particularly exfoliation corrosion resistance. In many of these types alloys, to obtain acceptable levels of exfoliation corrosion resistance, an additional aging or stabilizing practice, i.e., a T7 temper practice, is employed to attain the desired exfoliation corrosion resistance. This temper practice includes Step No. 11 in FIG. 1. As an example, AA7075 T73 for extrusions can include a two-stage aging process wherein the first stage heats the extrusion to 250° F. (121° C.) for 3–30 hours followed by a second heating to 325° F. (163° C.) for 15–18 hours. As another example, AA7150-T77511 requires that extrusions fabricated with this temper show exfoliation corrosion resistance equal to or better than level EB.

In view of the disadvantages noted above in processing AA7000 series alloys, a need has developed to provide improved corrosion resistance without a loss of mechanical properties. In addition, a need has developed to increase the productivity of hot working these types of alloys without the loss of surface quality. Finally, a need has developed to produce a T5 temper product for "hard to extrude" aluminum alloys.

The present invention solves these needs by providing a method of improving the corrosion resistance of AA7000 series alloy without the need for a T7 temper practice. In addition, the inventive method increases the hot working rate for these alloys while maintaining acceptable surface quality. Finally, the inventive method attains T6 temper practice properties in an AA7000 series alloy by following a T5 temper practice. An integral part of the inventive methods described above is the utilization of a starting material having a globular and non-dendritic microstructure for the hot working step.

The formation of globular microstructures in aluminum alloys as a precursor to subsequent shaping is known. U.S. Pat. No. 5,730,198 to Sircar discloses such a method. Other techniques to form globular and non-dendritic microstructures include such methods as SIMA (strain-induced melt activated), magnetohydrodynamic (MHD) casting and rheocasting as disclosed in the Metal Handbook, volume 15, $9^{th}$ edition, 1988 in an article entitled "Semisolid Metal Casting and Forging by Kenny, et al." Each of these disclosures is herein incorporated by reference. While the formation of globular microstructures in aluminum alloys is known, the prior art fails to recognize the improvements in processing parameters and corrosion resistance as described above using a starting workpiece having such a microstructure.

SUMMARY OF THE INVENTION

Accordingly, it is a first object of the present invention to provide a method of increasing the hot working productivity of AA7000 series aluminum alloys while maintaining acceptable surface appearance.

Another object of the present invention is to provide a method of attaining mechanical properties in AA7000 series aluminum alloys consistent with T6 temper practices using only a T5 temper practice.

A still further object of the present invention is to provide a method of improving the corrosion resistance of zinc containing aluminum alloys, particularly AA7000 series aluminum alloys.

One other object of the present invention is to provide aluminum alloy products from the inventive methods.

Other objects and advantages of the present invention will become apparent as a description thereof proceeds.

In satisfaction of the foregoing objects and advantages, the present invention provides a method of improving the corrosion resistance of an aluminum alloy comprising the steps of providing an aluminum alloy workpiece containing zinc as a major alloying element and having a globular non-dendritic microstructure. The alloy, in workpiece form, is heated, hot worked and quenched. The workpiece is then aged (naturally or artificially) whereby the exfoliation corrosion resistance of the aged workpiece is at least equal to the exfoliation corrosion resistance of an aluminum alloy having the same composition and processed using a T7 temper practice.

The aluminum alloy can contain zinc, magnesium and copper as major alloying elements and be selected from one of the class of alloys under the AA7000 series alloys, e.g., AA7075.

The globularizing step is preferably a thermal conversion of an as-cast material wherein the cast material is heated at a temperature between about 980° F. and 1180° F. (527° C. and 638° C.) for between 2–10 hours and forced air cooled. More preferably, the temperature ranges between 1020° F. and 1060° F. (549° C. and 571° C.) and the time ranges between 2 and 6 hours. Other processes such as casting processes which form the non-dendritic and globular structure can be used as the starting material. The starting material could be a cast and subsequently worked material as well.

While any hot working operation is adaptable for the invention, extrusion is preferred given the hard to extrude nature of the AA7000 series alloys. With the inventive method, the exfoliation corrosion resistance rating can be at least EB, such a rating equivalent to T7 temper practice ratings for these types of alloys.

The method of the invention also improves the hot working productivity of an aluminum alloy containing zinc as a major alloying element or zinc, magnesium and copper as major alloying elements, e.g., an AA7000 series alloy. In this method, the aluminum alloy workpiece having the globular non-dendritic microstructure is heated, hot worked and quenched. The quenched workpiece is then aged, whereby step (a) permits the hot working to be conducted at a rate without substantial surface damage to the workpiece surface and whereby the aged product has mechanical properties equivalent to the aluminum alloy when processed using a T6 temper practice.

Again, the hot working is preferably extrusion and the hot working rate as an extrusion speed can be at least twice the extrusion speed of the same aluminum alloy when homogenized prior to step (b) and conventionally processed to attain T6 properties. The globularizing treatment is the same as described above for improved corrosion resistance. The inventive method not only improves the hot working productivity without a loss of surface quality, it achieves T6 temper properties of an AA7000 series alloy by practicing a T5 temper practice. Along with these improvements, an exfoliation resistance rating of at least EB is achieved with the same T5 temper practice.

The inventive method provides an AA7000 series alloy product having T6 properties without the need for a separate solution heat treating, quenching and aging sequence. Similarly, an AA7000 series alloy product is provided which has at least an EB EXCO rating which is comparable to AA7000 series alloys requirements after these alloys have been conventionally solution heat treated, quenched and subjected to a two step artificial aging sequence.

BRIEF DESCRIPTION OF THE DRAWINGS

Reference is now made to the drawings of the invention wherein.

DESCRIPTION OF THE PREFERRED EMBODIMENTS

Figure 1:
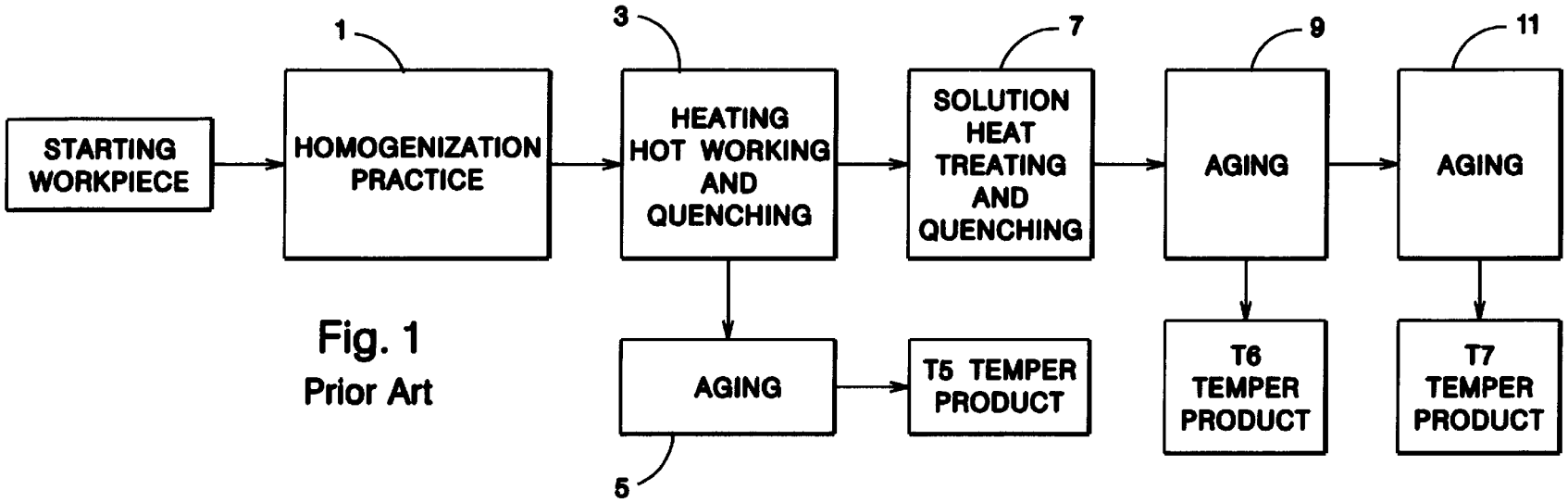
Fig. 1 Prior Art
FIG. 1 is a flow diagram depicting prior art processing modes for AA7000 series aluminum alloys.

The present invention provides significant improvements in the processing of aluminum alloys containing zinc as a major alloying element, more particularly, alloys having zinc, magnesium and copper as major alloying elements. These types of alloys are found in the AA7000 series alloys.

The improvements over conventionally processed aluminum alloys occur in terms of eliminating energy consuming steps and those steps tending to compromise mechanical properties and corrosion resistance. With the inventive method, corrosion resistance, particularly exfoliation and stress corrosion cracking resistance, can be obtained in the above-identified class of alloys without the need for a T7 temper. Similarly, mechanical properties equivalent to T6 temper properties can be obtained with these types of alloys using only a T5 temper practice. The invention also permits increased hot working productivity without an adverse effect on surface quality in the hot working operation.

In its broadest embodiment, the inventive method is applicable to the class of aluminum alloys having zinc as its majoring alloying element, more preferably, those including zinc, magnesium and copper as major alloying elements. A more preferred class of alloys include the AA7000 series alloys.

In one mode, the alloys can be conventionally cast in any shape, the shape depending on the desired final product configuration. Since the conventional casting aspect of the invention is deemed conventional, a further detail thereof is not deemed necessary for understanding of the invention.

Once the material is cast into a given shape, it is then preferably thermally converted to form a starting workpiece having a globular and non-dendritic microstructure. A preferred method to produce the non-dendritic globular microstructure is to thermally convert the as-cast dendritic structure by heating it at a temperature for a sufficient time to globularize the as-cast structure, i.e., form it into a non-dendritic spherical or globular microstructure. The temperature range can extend from about 980° F. (527° C.) to about 1200° F. (649° C.). The time at temperature can vary depending on the size of the workpiece and the actual temperature. Generally, the time can extend up to 10 hours, the heating followed by forced air cooling or its equivalent. More preferably, the temperature range is between 1020° and 1060° F. (549° and 571° C.) for time ranging between 2 and 6 hours. This thermal conversion process contrasts with conventional homogenization practice wherein an aluminum alloy material to be hot worked is heated at lower temperatures and at much longer times. The thermal conversion treatment described above effectively converts the dendritic cast structure to a spherical or globular non-dendritic microstructure for subsequent processing as described below. The thermal conversion treatment can also follow the teachings of U.S. Pat. No. 5,730,198 to Sircar.

As an alternative mode to conventional casting and thermal conversion, the starting workpiece for the inventive method can be made by other processes which form these spherical or globular and non-dendritic microstructure. Examples of these include casting processes such as rheocasting, magnetohydrodynamic (MHD)casting or strain induced melt activated (SIMA) processing. The above-listed processes also produce a starting workpiece having the globular and non-dendritic cast structure. However, the conversion treatment is preferred since the alternative modes described above require special casting arrangements and can be more costly.

Figure 2:
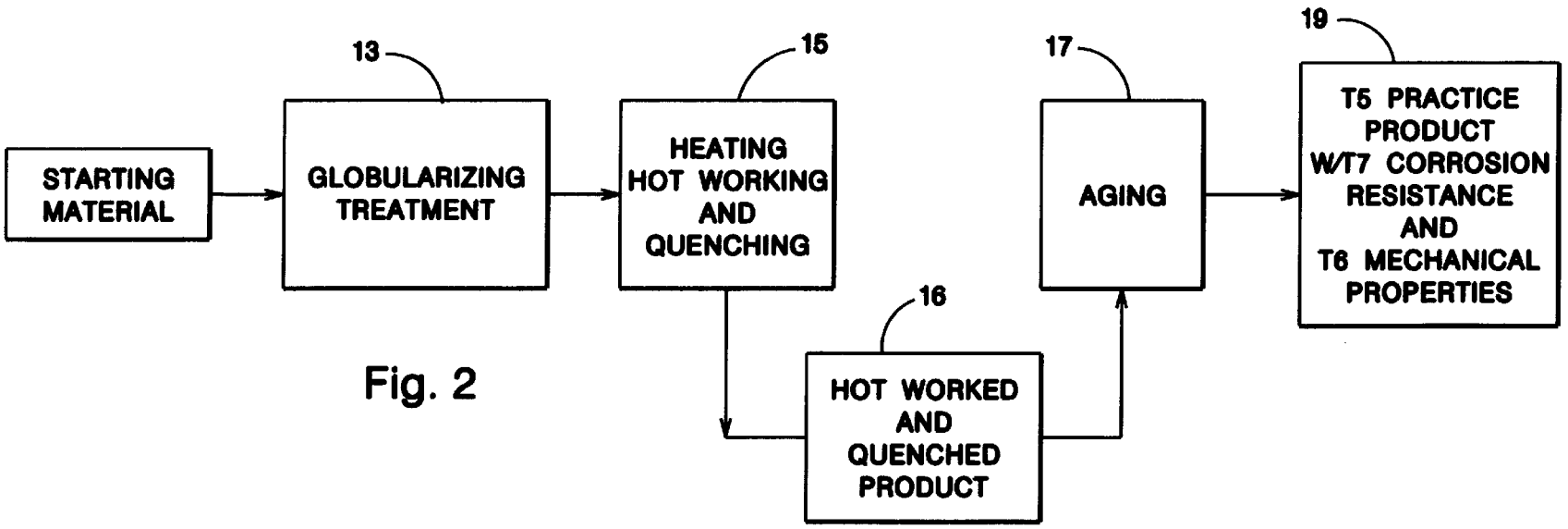
FIG. 2 is a flow diagram depicting one mode of the invention.

Once the starting workpiece is treated to form the globular and non-dendritic microstructure, it can then be processed in a hot working operation to form the desired shape. One mode of the inventive method is schematically depicted in FIG. 2 wherein the globularizing treatment is designated by the reference numeral 13. Following step 13, the heating, hot working and quenching step is represented by reference numeral 15. The product from step 15 is identified by reference numeral 16. Alternatively, the hot worked and quenched product can than be subjected to the aging step 17 so as to form the product 19 having T6 properties and T7 corrosion resistance without the need for separate solution heat treating, quenching and aging or solution heat treating, quenching and multiple step aging.

Step 15 of FIG. 2 encompasses heating the starting workpiece up to a desire hot working temperature followed by subjecting the heated workpiece to the hot working operation. It is believed that the inventive method can be applied to any hot working operation such as forging, rolling, impact extruding and extruding. A preferred hot working operation is extrusion.

The actual parameters for the heating for hot working and quenching are related to the type of hot working operation and the hot worked shape. The parameters useful for the invention are the same as those conventionally used in the hot working operations of forging, rolling, extruding and the like as described above. Similarly, the same type of quenching parameters applicable to the prior art processes are deemed applicable to the inventive processing. One skilled in the art would be clearly cognizant of the parameters necessary to process a workpiece of a given size to form a hot worked product of a desired end size. Consequently, a further description of the details of the heating, hot working and quenching steps of the inventive processing is not deemed necessary for its understanding. The hot working rate is increased over prior art rates as explained below.

As stated above, extrusion is a preferred hot working operation, particularly since the AA7000 series alloys are generally classified as "hard to extrude." By using the inventive method, a workpiece can be extruded at significantly higher extrusion speeds without damage to the extruded product surface. With these higher extrusion speeds, the quenching following extrusion is of a sufficient magnitude to permit the alloying elements of the aluminum alloy to remain in solution and be precipitated in a subsequent aging process. The subsequent aging process, designated as step 17 in FIG. 2, allows the hot worked, quenched and aged product to have T6 mechanical properties with only a T5 temper practice.

The aging step 17 again is considered conventional T5 temper practice aging that is well-known in the art. Generally, aging for these types of alloys is done at temperatures between 200° F. and 300° F. (93° F. and 149° C.) for times up to 36 hours. Generally, the aging temperature ranges between 250° and 300° F. (121° to 149° C.).

The hot working rates referenced above are significantly improved over prior art rates. For example, for extrusions of AA7075 alloys, the conventional extrusion speed may range up to 3 feet (0.91 m) per minute. However, using the inventive processing, extrusion speeds of up to almost 15 feet (4.57 m) per minute can be achieved. These high hot working productivity rates are realized while maintaining acceptable surface quality. Table 1 shows a comparison between prior art practices using standard homogenization heating prior to hot working and the invention. As is evident from Table 1, only the inventive processing gives a fast extrusion speed, good surface quality and acceptable aged mechanical properties. In other words, an AA7000 series alloy can be processed using a T5 temper practice while obtaining T6 temper properties, acceptable surface finish and, as shown below, T7 exfoliation corrosion resistance ratings. These results are totally unexpected in light of the extent of the prior art practices to date.

While the inventive process has been characterized in terms of producing a T5 temper practice product, the inventive method can be used to produce just a hot worked product as shown in FIG. 2, or alternatively, a product which is subsequently given other tempers, i.e., agings, such as a W temper, a T4 temper, a T6 temper, or T7 temper if so desired.

TABLE 1

| Practice | Extrusion Speed | Surface Quality | Press Quenched and Art Aged Mechanical Properties |
|---|---|---|---|
| Std. Homogenization | SLOW | GOOD | POOR |
| Std. Homogenization | FAST | POOR | ACCEPTABLE |
| Invention | FAST | GOOD | GOOD |

In order to more fully demonstrate the unexpected results associated with the inventive methods, trials were conducted to compare the prior art to the invention. The trials described below are intended to illustrate the inventive methods and products therefrom but are not considered to be limiting to their scope.

As described above, invention is deemed to be applicable to the zinc-containing aluminum alloys generally classified as AA7000 series alloy, particularly those containing copper. The trials discussed below used an AA7075 material for processing.

The registered composition for this material, in weight percent, is as follows: a maximum of 0.40% silicon; a maximum of 0.50% iron; 1.2–2.0% copper; a maximum of 0.30% manganese; 2.1–2.9% magnesium; 0.18–0.28% chromium; 5.1–6.1% zinc; a maximum of 0.20% titanium; a maximum of 0.05% for each other element; a maximum of 0.15% of the total of other elements with the balance being aluminum and incidental impurities.

The AA7075 material was used in billet form (9" diameter×19" long) (228 mm×483 mm)and subjected to extrusion as the hot working method. The billet was obtained from a conventional casting operation. Prior to the extrusion step, each of the billets was subjected to a thermal practice to compare the prior art or conventionally processed material to the material processed according to the invention. The billets following one mode of the invention were thermally converted or subjected to a globularizing treatment by heating the billet for 4 hours at a 1,060° F. (571° C.) followed by forced air cooling. This thermally converted material is designated as sample TC1. A second sample, designated as TC2, was thermally converted by heating it for 4 hours at 1,050° F. (567° C.) followed by forced air cooling. Micrographs confirmed that these thermal conversions produced a globular non-dendritic microstructure in the billets for subsequent working, e.g., extrusion.

Two other AA7075 billets were used for comparison purposes. The first one, designated R1, was subjected to a conventional homogenization practice wherein the billet was heated at a 100° F. per hour rate to 560° F. (293° C.), held for one hour and then heated again at a 100° F. per hour rate to 850° F. (450° C.) and held for 21 hours, followed by forced air cooling. A second sample, identified as K2, was purchased and used in the cast and homogenized condition. As is well known in the art, the conventional homogenization practice heats the as cast material so that its alloying elements have a chance to diffuse throughout the matrix to produce a homogenized structure. The conventional homogenization practice, while creating a more uniform distribution of elements in the aluminum alloy matrix, does not significantly alter the grain structure formed during the casting process.

Following the thermal treatment of each billet, the billets were extruded to 1" rods with inlet and outlet extrusions temperatures of about 875° F. (468° C.) and tested for mechanical properties as shown in Table 2. For Table 2 and the following Tables, UTS represents ultimate tensile strength in ksi, YS represents yield strength in ksi and Elong. represents elongation in percent (conversion, ksi/1.422=kg/mm$^2$). As is evident from Table 2, the globularizing treatment given to samples TC1 and TC2 does not adversely effect its mechanical properties.

TABLE 2

AS EXTRUDED MECHANICAL PROPERTIES

| Sample | UTS | YS | Elong. |
|---|---|---|---|
| TC1 | 83.3 | 60.7 | 14.5 |
| TC2 | 84.8 | 61.9 | 14.5 |
| R1 | 87.9 | 63.4 | 15.5 |
| K2 | 85.7 | 63.2 | 10.3 |

The as extruded billets were then subjected to artificial aging so that the artificially aged product represented a T5 temper material. The billets were subjected to conventional aging practice wherein the billets were heated at a rate of 1.5° F. per minute to 250° F. (120° C.) and held for 24 hours followed by air cooling. Table 3 shows the result of artificial aging. Quite surprisingly, Table 3 shows that the billets given the globularizing treatment prior to extrusion can be extruded at speeds of almost 5 times that of the conventional processed extrusions without loss of surface quality and mechanical properties. Table 3 demonstrates that a hard to extrude alloy, i.e., an AA7075 alloy, can be extruded at rates at least twice as fast as conventionally processed AA7075 material and attain properties similar to T6 temper properties. The T6 temper properties are a minimum 81 ksi (57 kg/mm$^2$) of ultimate tensile strength, 72 ksi (50.6 kg/mm$^2$) of yield strength and a minimum of 7% elongation.

Quite surprisingly, the billets subjected to the globularizing treatment were able to be extruded at significantly higher speeds without loss of surface quality and while still maintaining mechanical properties. In other words, the inventive method permits treatment of an AA7000 series alloy with a T5 temper practice while attaining T6 temper practice properties. Again, as is clear from Table 3, examples TC1 and TC2 all meet the minimum properties noted above for T6 temper. It should be noted that while the mechanical properties of the conventionally processed samples R1 and K2 also meet the T6 temper property minimums listed above, the extruded and aged product does not exhibit an acceptable surface quality that meet commercial requirements. More particularly, the samples were subjected to extrusion speeds more than 3 feet per minutes which resulted in poor surface quality as noted in Table 3. As explained above, using conventional extrusion speeds (<3 ft/min(0.91 m/min)) for these conventionally homogenized billets resulted in acceptable surface quality but mechanical properties which did not meet the T6 temper properties listed above. This reaffirms the unexpected results of the invention when using the globularizing treatment prior to the hot working, quenching and aging practices. Again, only through use of the inventive process can AA7000 material be subjected to a T5 temper practice and meet T6 mechanical properties while still maintaining acceptable surface quality.

TABLE 3

AS EXTRUDED + ARTIFICIALLY AGED* MECHANICAL PROPERTIES

| Sample | Extrusion Speed (ft./min.) | Surface Quality | UTS | YS | Elong. |
|---|---|---|---|---|---|
| TC1 | Up to 14.5 | GOOD | 90.1 | 84.6 | 12.5 |
| TC2 | Up to 14.5 | GOOD | 91.5 | 85.4 | 13.0 |
| R1 | Up to 8 | POOR for speeds > 3 ft./min. | 93.6 | 85.4 | 13.5 |
| K2 | Up to 8 | POOR for speeds > 3 ft./min. | 94.6 | 88.4 | 11.0 |

*HEAT AT 1.5° F./MIN TO 250° F. (120° C.) AND HOLD FOR 24 HRS. FOLLOWED BY AIR COOL.

Table 4, 5 and 6 show the four samples being subjected to other temper practices. Table 4 represents a W temper, Table 5 represents a T4 temper and Table 6 represents a T6 temper. As is evident from these three Tables, the samples processes according to the inventive method show consistent mechanical properties with the conventionally processed samples R1 and K2.

TABLE 4

AS EXTRUDED + SOLUTIONIZED MECHANICAL PROPERTIES

| Sample* | UTS | YS | Elong. |
|---|---|---|---|
| TC1 | 65.4 | 40.6 | 14.0 |
| TC2 | 65.4 | 39.7 | 13.8 |
| R1 | 66.7 | 40.0 | 12.5 |
| K2 | 70.8 | 44.9 | 12.3 |

*TESTED WITHIN 2 HRS. AFTER SOLUTIONIZING AT 870° (406° C.) FOR 1 HR. AND WATER QUENCHING.

TABLE 5

AS EXTRUDED, SOLUTIONIZED & NATURALLY AGED MECHANICAL PROPERTIES

| Sample* | UTS | YS | Elong. |
|---|---|---|---|
| TC1 | 78.6 | 53.5 | 14.5 |
| TC2 | 78.9 | 53.5 | 14.5 |
| R1 | 82.2 | 56.1 | 16.5 |
| K2 | 83.4 | 57.4 | 15.0 |

*TESTED WITHIN 2 HRS. AFTER SOLUTIONIZING AT 870° (406° C.) FOR 1 HR. AND WATER QUENCHING.

TABLE 6

AS EXTRUDED SAMPLES SOLUTIONIZED & ARTIFICIALLY AGED*

| Metal | UTS | YS | Elong. |
|---|---|---|---|
| TC1 | 93.2 | 87.6 | 14.0 |
| TC2 | 93.2 | 87.5 | 13.0 |
| R1 | 95.7 | 88.7 | 14.5 |
| K2 | 97.7 | 92.9 | 11.0 |

*HEAT AT 1.5° F./MIN TO 250° F. (120° C.) AND HOLD FOR 24 HRS. FOLLOWED BY AIR COOL.

To assert the improved corrosion resistance associated with the inventive methods, exfoliation corrosion resistance testing and stress corrosion cracking testing were performed on the samples identified above. Table 7 shows the exfoliation corrosion resistance testing for materials processed according to both a T5 temper and a T6 temper. Since EXCO ratings are well known in the art of aluminum alloys, a further description thereof is not deemed necessary for understanding of the exfoliation corrosion test results. With particular reference to the material subjected to the T5 temper practice, the samples TC1 and TC2 of the invention all exhibited excellent exfoliation corrosion existence. Sample TC2 showed EA ratings for both the T/4 and T/2 regions, this rating exceeding the EB and EC ratings of material processed according to the conventional practice. Table 7 clearly shows that an acceptable exfoliation corrosion resistance can be attained for AA7000 series alloys without having to resort to a T7 temper practice. Table 8 details EXCO test results using ASTM G34-90 for samples processed in the same manner as the Table 7 samples. Again, superior corrosion resistance is attained using the inventive processing.

Table 9 shows a similar unexpected result when comparing the samples for the T5 temper practice with respect to stress corrosion cracking. Again, since this testing is conventional, a further detailed description is not deemed necessary for understanding of the test results. Samples TC1 and TC2 each showed 2 out of 3 tests whereby no failure occurred after 9 days of testing. This contrasts with 5 out of 6 failures in 9 days or less for samples R1 and K2, both subjected to conventional T5 temper practice. The results of Table 9 further substantiate the unexpected corrosion resistance improvements when processing AA7000 series alloys according to the inventive method. It should be understood that the samples as described above for Tables 4 to 6 were processed as described for Table 2.

TABLE 7

EXCO CORROSION RESISTANCE TEST RESULTS PER ASTM G36-72

| SAMPLE | Process | Temper | Exco Ratings Surface | T/4 | T/2 |
|---|---|---|---|---|---|
| TC1 | Converted + Extruded + Solutionized + Art. Aged | T6 | P | EA | EA |
| TC2 | Converted + Extruded + Solutionized + Art. Aged | T6 | P | EA | EA |
| R1 | Std. Homo. + Extruded + Solutionized + Art. Aged | T6 | EA | EA | EA |
| K2 | Std. Homo. + Extruded + Solutionized + Art. Aged | T6 | N/EA | EA | EA |
| TC1 | Converted + Extruded + Art. Aged | T5 | P | GC | GC |
| TC2 | Converted + Extruded + Art. Aged | T5 | P | EA | EA |
| R1 | Std. Homo. + Extruded + Art. Aged | T5 | P/EA | EC | EC |
| K2 | Std. Homo. + Extruded + Art. Aged | T5 | P/N | BB | EB |

N - No appreciable attack
P - Pitting
GC - General Corrosion
PB - Pit Blistering
EA-EB-EC - Degrees of Exfoliation
All samples cleaned per ASTM Std. G34-72.
Homo. Represents conventional homoqenization practice.

TABLE 8

EXCO CORROSION RESISTANCE TEST RESULTS PER ASTM G34-90

| SAMPLE ID | Temper | Exco Rating ASTM G34-90 Surface | T/4 | T12 |
|---|---|---|---|---|
| TC1 | T6 | EA | BA | BA |
| TC2 | T6 | N | EA | EA |
| R1 | T6 | PB | PB | EA |
| K2 | T6 | N/PB | EB | EB |
| TC1 | T5 | N | GC | EA |
| TC2 | T5 | N | EA | EA |
| R1 | T5 | EB/P | BB | EB |
| K2 | T5 | N/P | EC | EC |

N - No appreciable attack
P - Pitting EA-EC = degrees of exfoliation
GC - General Corrosion
PB - Pit Blistering

TABLE 9

SCC RESULTS FOR 7075 THERMAL CONVERSION vs. STD. PRACTICE*

| Sample ID | Process | Days Temper | to Failure | No Failure (In Days) |
|---|---|---|---|---|
| TC1 | Converted + Extruded + Solutionized + Art. Aged | T6 | 5, 5, 6 | |
| TC2 | Converted + Extruded + Solutionized + Art. Aged | T6 | 2, 5, 6 | |
| R1 | Std. Homo. + Extruded + Solutionized + Art. Aged | T6 | 5 | 9, 9 |
| K2 | Std. Homo. + Extruded + Solutionized + Art. Aged | T6 | | 9, 9, 9 |
| TC1 | Converted + Extruded + Art. Aged | T5 | 5 | 9, 9 |
| TC2 | Converted + Extruded + Art. Aged | T5 | 5 | 9, 9 |
| R1 | Std. Homo. + Extruded + Art. Aged | T5 | 5, 7, 9 | |
| K2 | Std. Homo. + Extruded + Art. Aged | T5 | 5, 5 | 9 |

*PER ASTM STD. G44, G38 (3 C RINGS PER LOT, STRESSED AT SO PERCENT OF THE YIELD STRENGTH FOR EACH MATERIAL)

The experimental trials conducted above clearly demonstrate that using the globularizing treatment for zinc containing aluminum alloys or AA7000 series aluminum alloys results in significant improvements in corrosion resistance and productivity. By eliminating the T7 temper practice, significant cost savings are realized in terms of energy. Similarly, eliminating the requirement for a separate solution heat treating quenching and aging step for these types of aluminum alloys represents a significant economic gain. In addition, hot working productivity is vastly increased since a working rate for these materials can be significantly increased, more than twice and as much as 5 times, when using the globularizing treatment prior to hot working. In addition, acceptable surface quality is maintained in spite of the increased hot working rates.

As such, an invention has been disclosed in terms of preferred embodiments thereof which fulfills each and every one of the objects of the present invention as set forth above and provides new and improved methods to improve the corrosion resistance and hot working productivity of AA7000 series aluminum alloys and products therefrom.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A method of improving the hot workability and corrosion resistance of an aluminum alloy containing zinc as a major alloying element comprising the steps of:

a) providing a cooled aluminum alloy workpiece containing zinc as a major alloying element and having a globular non-dendritic microstructure;

b) heating the workpiece followed by hot working the workpiece;

c) quenching the workpiece directly after the hot working step; and d) aging the quenched workpiece, whereby subjecting the workpiece having the globular non-dendritic structure to steps (b)–(d) provides improved exfoliation corrosion resistance without overaging the quenched workpiece, increased hot working rates over alloys having a dendritic structure that are hot worked, and acceptable mechanical properties without solution heat treating the workpiece after hot working and before quenching.

2. The method of claim 1, wherein the aluminum alloy contains zinc, magnesium and copper as major alloying elements.

3. The method of claim 2, wherein the aluminum alloy is an AA7000 series alloy.

4. The method of claim 3, wherein the AA7000 series alloy is an AA7075 alloy.

5. The method of claim 1, wherein step (a) further comprises subjecting the aluminum alloy to a thermal conversion step wherein the alloy is heated at a temperature between about 980° F. and 1180° F. (527 and 638° C.) for between 2–10 hours and forced air cooled.

6. The method of claim 5, wherein the temperature ranges between 1020° F. and 1060° F. (549 and 571° C.) and the time ranges between 2 and 6 hours.

7. The method of claim 1, wherein the hot working step is extrusion.

8. The method of claim 1, wherein the exfoliation corrosion resistance rating is at least EB.

9. The method of claim 1, wherein the hot working is extrusion and the hot working rate as an extrusion speed is at least twice the extrusion speed of the same aluminum alloy when homogenized prior to step (b) to form the dendritic structure.

10. A product made by the method of claim 1, wherein the aged workpiece exhibits an exfoliation corrosion resistance rating of EA, and the mechanical properties of the aged workpiece of step (d) are a minimum of 81 ksi tensile strength, a minimum of 72 ksi yield strength, and a minimum of 7% elongation.

11. A method of improving the hot workability and corrosion resistance of an AA7000 series aluminum alloys comprising the steps of:

a) heating the AA7000 series aluminum alloy workpiece at a temperature between about 980° F. and 1180° F. (527° F. and 638° C.) for between 2–10 hours followed by cooling to form a globular non-dendritic microstructure in the workpiece;

b) heating the workpiece followed by extruding the workpiece;

c) quenching the workpiece directly after the extruding step; and d) aging the quenched workpiece, whereby subjecting the workpiece having the globular non-dendritic structure to steps (b)–(d) provides improved exfoliation corrosion resistance without overaging the quenched workpiece, increased extrusion rates over alloys having a dendritic structure that are extruded, and acceptable mechanical properties without solution heat treating the workpiece after extruding and before quenching.

12. An extrusion made by the method of claim 11, wherein the aged extrusion exhibits an exfoliation corrosion resistance rating of EA, and the mechanical properties of the aged extrusion of step (d) are a minimum of 81 ksi tensile strength, a minimum of 72 ksi yield strength, and a minimum of 7% elongation.

13. The method of claim 11, wherein the temperature ranges between 1020° F. and 1060° F. (549° C. and 571° C.) and the time ranges between 2 and 6 hours.

14. The method of claim 11, wherein the aged workpiece exhibits an exfoliation corrosion resistance rating of at least EB.

15. The method of claim 11, wherein the mechanical properties of the aged workpiece of step (d) are a minimum of 81 ksi tensile strength, a minimum of 72 ksi yield strength, and a minimum of 7% elongation.

* * * * *